US007442158B2

(12) United States Patent
Ratz et al.

(10) Patent No.: US 7,442,158 B2
(45) Date of Patent: Oct. 28, 2008

(54) FOLDING APPARATUS

(75) Inventors: Holger Ratz, Frankenthal (DE); Rudolf Stäb, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 59 days.

(21) Appl. No.: 10/586,126

(22) PCT Filed: Jan. 12, 2005

(86) PCT No.: PCT/EP2005/050108

§ 371 (c)(1),
(2), (4) Date: Jul. 14, 2006

(87) PCT Pub. No.: WO2005/068335

PCT Pub. Date: Jul. 28, 2005

(65) Prior Publication Data

US 2007/0167305 A1 Jul. 19, 2007

(30) Foreign Application Priority Data

Jan. 16, 2004 (DE) ..... 10 2004 002 348

(51) Int. Cl.
*B31F 1/08* (2006.01)

(52) U.S. Cl. ..... 493/460; 493/416; 493/424; 493/425; 493/428; 493/434; 493/443; 493/435; 493/359

(58) Field of Classification Search ..... 493/405, 493/416, 424–429, 352, 365, 356–360, 442–443, 493/434–435

See application file for complete search history.

(56) References Cited

U.S. PATENT DOCUMENTS

| | | | |
|---|---|---|---|
| 4,974,822 | A | 12/1990 | Richter |
| 5,484,379 | A | 1/1996 | Stab |
| 5,494,270 | A | 2/1996 | Laubscher |
| 6,093,139 | A | 7/2000 | Belanger |
| 6,159,138 | A | 12/2000 | Lanvin et al. |
| 6,358,192 | B1 | 3/2002 | Michalik |
| 6,605,027 | B1 | 8/2003 | Cloutier et al. |
| 6,652,437 | B1 | 11/2003 | Bergeron et al. |

FOREIGN PATENT DOCUMENTS

| | | |
|---|---|---|
| DE | 42 29 059 | 3/1994 |
| DE | 43 16 134 C2 | 3/1997 |
| DE | 197 16 625 A1 | 11/1998 |
| DE | 198 57 507 A1 | 7/1999 |
| DE | 101 55 037 A1 | 8/2002 |
| EP | 0 931 748 B1 | 1/1999 |

*Primary Examiner*—Christopher Harmon
(74) *Attorney, Agent, or Firm*—JonesTullarCooper, PC

(57) ABSTRACT

A folding apparatus includes at least a first folding cylinder and a second, folding jaw cylinder. A third measuring cylinder is also provided. The measuring cylinder is usable to cut product sections or signatures of a determined length L from an endless web. The first cylinder is embodied, in one embodiment, as an engaging cylinder, and as a second embodiment as a puncture cylinder. In both embodiments, the product section or signatures which are produced, have the same length.

17 Claims, 6 Drawing Sheets

FOLDING APPARATUS

CROSS-REFERENCE TO RELATED APPLICATIONS

This patent application is the U.S. National Phase, under 35 USC 371, of PCT/EP2005/050108, filed Jan. 12, 2005; published as WO 2005/068335 A1 on Jul. 28, 2005 and claiming priority to DE 102004002348.4, filed Jan. 16, 2004, the disclosures of which are expressly incorporated herein by reference.

FIELD OF THE INVENTION

The present invention is directed to folding apparatuses. The folding apparatus includes a first cylinder, a second, folding jaw cylinder and a third, cutting cylinder. The first cylinder may be a gripper cylinder or a spur needle cylinder.

BACKGROUND OF THE INVENTION

In the processing of web-shaped goods, a basic differentiation is typically made between folding apparatuses with spur needle cylinder or folding apparatuses with gripper cylinders. The folding apparatus is constructed in the appropriate configuration as a function of customer requests and/or as a function of the product to be formed. Based on properties, in connection with the use of gripper cylinders, as will be discussed subsequently, considerable differences arise, as a rule, in the formation of the same size product. Such differences result, for example, in the cylinder size, in the position of the cylinders with respect to each other and therefore in the embodiment of the frame, the drive geometry of the drive train, and many others. In connection with the construction of a folding apparatus, these differences have required, up to the present, a restriction to a type of folding apparatus, as well as to dual construction of the same folding apparatus format of both types.

A spur needle cylinder has spur needles, and in particular has retractable spur needles on its circumference, which spur needles pick up the continuous web, which web, following further conveyance, is transversely cut into sections. The next following section is then grasped by the subsequent spur needles which are following on the circumference of the spur needle cylinder, and is cut in the same way. No spacing is required between the web sections following each other on the circumference of the spur needle cylinder, so that the spur needle cylinder can have the same circumferential velocity as the conveying speed of the continuous web. Spur needle cylinders and subsequent cylinders, such as, for example, folding jaw cylinderscan have the same circumference.

A gripper cylinder has one or several grippers on its shell face, which grippers are movable between a gripping or clamping position, in which they maintain a leading end of a flat material, which is to be conveyed on the gripper cylinder, pressed against the shell face, and a release position in which the flat material can again be detached from the cylinder, or in which a new piece of flat material can be picked up and clamped. The grippers generally perform a pivot movement between these two positions. Since the amounts of time available for either clamping or for releasing a product are short, the pivot movement must be done at a high speed. A movement amplitude between the clamping position and the release position of the gripper should be as short as possible in order to keep accelerations, which stress the material, within limits.

To prevent the infliction of damage, by a gripper, to a trailing end of a piece of flat material which is maintained on the cylinder, because of the movement of a gripper which follows the piece of flat material on the cylinder in the circumferential direction, in the course of clamping a following piece of flat material, most gripper cylinders are configured to receive pieces of flat material which are supplied to the gripper cylinder separated from each other. The pieces of flat material thus each come to rest on the gripper cylinder, while forming a gap between successive ones of the pieces. The gripper can move in the resulting gap without touching the previous piece of material. If these pieces of flat material had previously been produced by being cut off a continuous web, it is necessary, in order to form such a gap, to accelerate the cut-off pieces to a speed which is greater than that of the continuous web prior to cutting of the web. However, if a conveying system, which conveys the products cut off the continuous web, runs faster than the conveyed continuous web after the pieces have been cut from the conveyed continuous web, this leads to slippage and therefore to friction between the conveying system and a leading section of the continuous web entering it, which leading section of the web necessarily still moves at the original speed of the continuous web prior to their cut-off. In the case of flat material with a sensitive surface, such as, for example, freshly printed products, this friction can negatively affect the quality of the surface, for example by the production of drag marks on the imprinted material, or by smearing of the ink. If the pieces of flat material are composed of a stack of sheets, which sheets are not connected with each other, the problem furthermore occurs that different friction at different sides of the stack can lead to the sheets being displaced with respect to each other. This can lead to the stack being pulled apart, which stack separation makes further use of the stack considerably more difficult.

It is particularly problematical if the pieces of flat material are being cut off the continuous web while they are directly in contact with the gripper cylinder, such as, for example, by the use of a rotating cutter cylinder which, together with the gripper cylinder, defines a cutting gap and which cutter cylinder severs the continuous web in cooperation with a thrust element of the gripper cylinder. To insure that the continuous web which is to be cut rests evenly against the surface of the gripper cylinder, the grippers must be capable of dipping or retracting into the interior of the gripper cylinder. After a piece of flat material has been cut off the continuous web, there is very little time which is available to grasp the newly created leading edge of the continuous web, by the use of a gripper, and to press this newly created leading edge against the surface of the cylinder. However, the path between the retracted position of the gripper and the extended position of the gripper, in which extended position the flat piece of material is pressed against the cylinder, is long and thus requires a high speed of the gripper movement. Such high speed can only be realized with the use of a high-quality, expensive drive mechanism. Moreover, wear, and therefore the susceptibility of the drive mechanism to breakdowns, is all the greater, the higher its operating speed is.

A gripper cylinder is known from EP 0 931 748 B1. This device is capable of conveying printed products which have been cut off a supplied continuous web without precession, i.e. without a space between the printed products following each other. With this gripper cylinder, a gripper is mounted on a shaft, which shaft is pivotably seated in the cylinder and by the use of a translatory mechanism which, when coupled to the pivot movement, drives the gripper to perform a parallel displacement. This translatory mechanism is used to displace the gripper between its retracted position and a position where it projects past the shell face of the cylinder, from which projected position it can be pivoted around the shaft to press the leading edge of a continuous web of printed products against the cylinder surface.

The construction of the translatory mechanism, nor how the movement of the translatory mechanism is to be driven are not specifically described. A mechanical coupling of the translatory mechanism to the rotation of the gripper cylinder would require extensive gearing. Although it is conceivable to provide an electrical or a hydraulic drive unit for the displacement, which drive unit pivots around the shaft, together with the gripper, the problem of supplying the necessary drive energy arises. Furthermore, such a drive unit would considerably increase the moment of inertia of the gripper to be pivoted and would therefore reduce the speed of movement of the gripper which could be reached.

A folding apparatus, which is configured without spur needles, and with a gripper cylinder is known from DE 42 29 059 A1, and in whose surface speed is precessed over the speed of the continuous web.

DE 197 16 625 A1 shows a folding apparatus with a spur needle cylinder. The spur needle cylinder, the cutter cylinder and the pre-folding cylinder are seated in a common frame.

SUMMARY OF THE INVENTION

The object of the present invention is directed to providing folding apparatuses.

In accordance with the present invention, the object is attained by the provision of a folding apparatus that uses a first cylinder, together with a second, folding jaw cylinder and a cutter cylinder. The first and second cylinders are both seated in a common frame. The seating arrangement of the cylinders in the frame is such that the drive geometry and the spacing between the first and second cylinders can be selected so that the first cylinder can be either a gripper cylinder or a spur needle cylinder. Product sections of the same length can be processed using either first cylinder whose circumferential speed correspond exactly to the feeding speed of the continuous web.

It is of particular advantage in accordance with the present invention, that the folding apparatus is constructed independently of the type of the first cylinder with either grippers or spur needles. A simple exchange of the first cylinder can be performed without it being necessary to alter the frame and the drive situation. For the same section length, it is possible to make a selection between the two types, grippers or spur needles, while maintaining the spatial arrangement of the cylinders and/or the drive elements. Until shortly before delivery, this first cylinder selection can be made by the customer. Alternatively, refitting can be performed in place without it being necessary to change the frame.

To shorten the movement distance between the gripper retracted position and the gripper clamping position, the present gripper cylinder uses a translatory, movement in addition to the pivot movement, generally the same as the gripper cylinder known from EP 0 931 748 B1. The difference is that a mechanism for driving the translatory movement is not pivotable, together with the gripper, around the pivot shaft of the latter and in this way does not increase the gripper's moment of inertia. Instead, the drive mechanism displaces the shaft of the gripper per se in the radial direction. Since the radial stroke which is required for clamping the flat material on, or for releasing it from the gripper cylinder is small, in comparison with the required movement amplitude of the gripper, in the circumferential direction, a small amplitude of the radial displacement movement suffices, which small radial displacement can be generated with only a little outlay in energy and with little stress of the mechanical components.

If the flat material to be clamped by the gripper is a stack of sheets, at the moment of clamping the stack of sheets, it is desirable to avoid imparting a movement component to the gripper in the circumferential direction, so that the stack is not subjected to shearing forces. Clamping is customarily accomplished only by a pivot movement of the gripper and therefore the exertion of a shearing force on a stack of sheets during clamping typically cannot be prevented. However, in connection with the present gripper, it is preferably provided that, in a final phase of the pivot movement into the clamping position, the first shaft is moved radially inward.

A simple and robust method of driving the radial inward movement of the first shaft is to mount it on a first arm, which first arm can be pivoted around a second shaft, which second shaft is fixed in place with respect to the cylinder body. The result is that the radial movement of the first shaft corresponds to a pivot movement of this first arm.

In the same way that the pivot movement of the gripper itself customarily takes place, this pivot movement of the first arm can be driven, in a simple way, by a cam disk. The cam disk does not rotate together with the gripper cylinder and has a shape which is scanned or traced or followed by a lever that is connected with the first arm.

Preferably, a coupling rod is provided for driving the pivot movement of the gripper between the retracted position and the clamping position. The coupling rod is hinged, on one side, on the gripper and is hinged, on the other side, on a second arm, which second arm is pivotable around a third shaft. The pivot movement of the second arm can also be driven, in the manner recited above, by a cam disk.

In a space-saving arrangement of the present invention, the second and the third shaft are located on opposite sides of the gripper in relation to the circumferential direction of the cylinder.

Of the two arms, the first one is oriented more in the circumferential direction, and the second one is oriented more in the axial direction of the cylinder body. In other words, the orientation of the first arm is closer to the circumferential direction than is that of the second one, and the orientation of the second one is closer to the axial direction than is that of the first one.

Preferably, a counter-thrust element is assigned to each gripper on the cylinder body. This counter-thrust element is used, in cooperation with a common cutter moving together with the gripper cylinder, for cutting flat material which is conveyed by the gripper cylinder and which is to be grasped by the gripper.

In relation to the direction of rotation of such a gripper cylinder, the gripper is arranged upstream of the counter-thrust element that is assigned to it. The surface section of the gripper cylinder, against which the gripper presses cut flat material, is preferably its counter-thrust element itself, whose elasticity in this way aids the cutting process, as well as the gripping.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
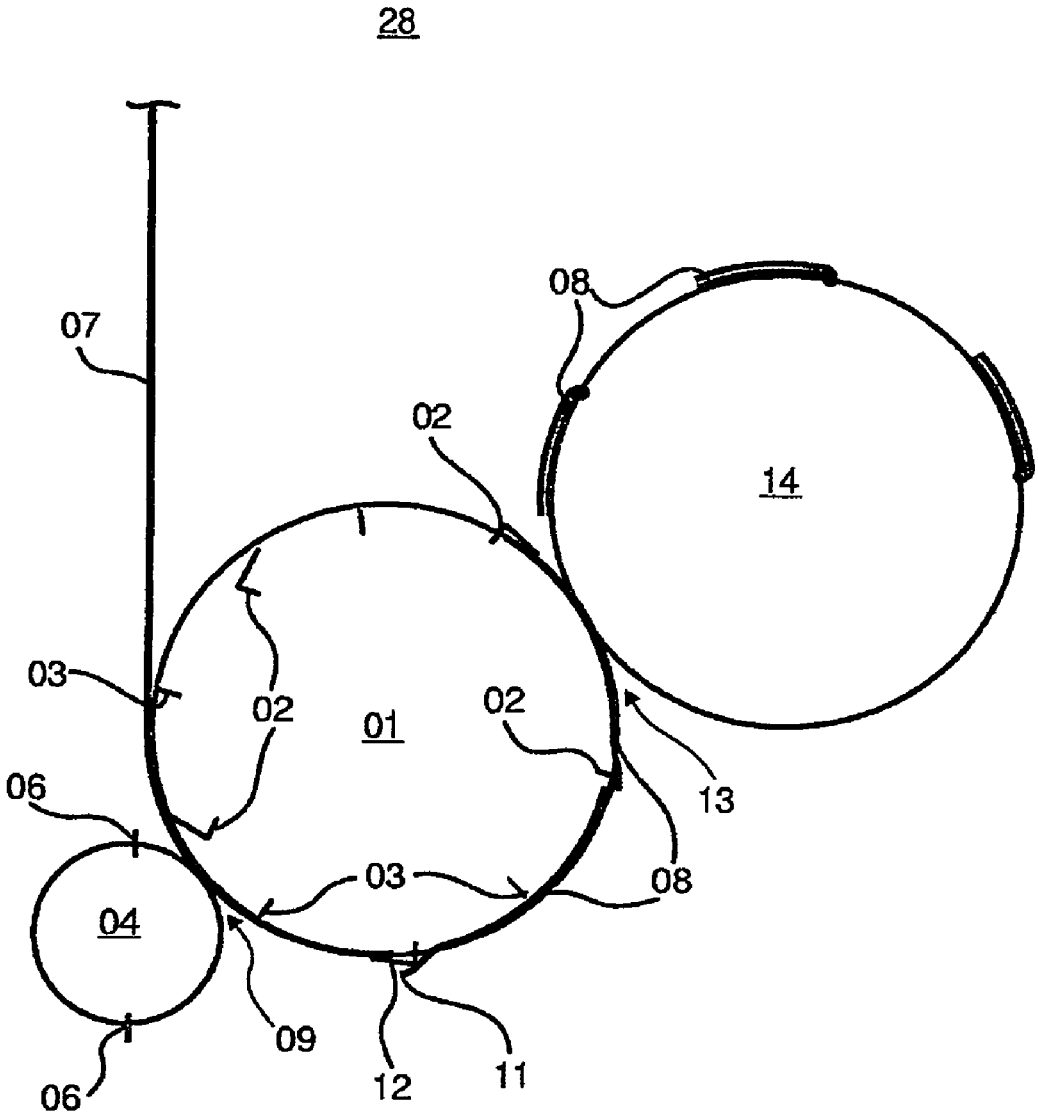
FIG. 1, a schematic side elevation representation of a transverse folding apparatus in accordance with the present invention, and utilizing a gripper cylinder, in FIG. 2, an enlarged partial sectional view through the gripper cylinder, showing the gripper in its retracted position, in FIG. 3, a partial sectional view, analogous to the one shown in FIG. 2, and showing the gripper in the course of its exiting the retracted position, in FIG. 4, a partial sectional view, showing the gripper in the clamping position, in FIG. 5, a partial sectional view, showing the gripper on its return into the retracted position, in FIG. 6, a schematic sectional view through a folding apparatus, and in FIG. 7, a schematic sectional view of a double folding apparatus.

A greatly simplified schematic sectional view through a folding apparatus 28, in accordance with the present invention, is shown in FIG. 1. The folding apparatus 28 comprises a first cylinder 01, such as, for example, a gripper cylinder 01 which, in the embodiment represented in FIG. 1, is equipped with five grippers 02 and with folding blades 03, respectively, which are evenly distributed in the circumferential direction of cylinder 01. The gripper cylinder 01, together with a cutter cylinder 04, which, in this embodiment is provided with two cutters 06, constitutes a cutting gap 09. A flat material 07, such as, for example, a continuous web or web group 07, which typically is assembled from a plurality of imprinted individual webs of material put on top of each other, such as, for example, paper webs, is separated into individual flat products 08, such as, for example, individual printed products 08 or printed sections 08, hereinafter sections 08, for short, each of a length L corresponding to a printed page, as the web group 07 passes through the cutting gap 09. The length L can also correspond to more than one printed page if, for example, further processing is intended to take place, such as the forming of a further transverse fold, for example.

During their respective passage through the cutting gap 09, the grippers 02 and the folding blades 03 are retracted into the interior of the gripper cylinder 01. The circumferential speed of the gripper cylinder 01 corresponds exactly to the feeding speed of the continuous web or web group 07, so that the printed products or sections 08, which are cut off the continuous web 07, follow each other, without gaps, on the circumference of the gripper cylinder.

Following their passage through the cutting gap 09, each of the sets of the grippers 02 are extended out of the gripper cylinder 01 underneath the trailing section 11 of the circumferentially prior one of the printed products 08 carried by the first cylinder 01, and are pivoted, opposite to the direction of rotation of the cylinder,to clamp the leading edge 12 of the continuous web 07 in place against the surface of the gripper cylinder 01. The trailing portions 11 of each of the printed product 08 are displayed away at some distance from the surface of the gripper cylinder 01. This does not hamper the even winding of the continuous web 07 on the gripper cylinder 01, because these trailing ends 11 are only displaced out away from the gripper cylinder after being cut off by the gripper cylinder 01 and the cutter cylinder 04.

The gripper cylinder 01 also forms a folding gap 13 with a second cylinder 14, such as, for example, a folding jaw cylinder 14. In the course of their passage through the folding gap 13, the folding blades 03 extend from the gripper cylinder 01 and insert the printed products 08 along a center line into folding jaws, which are not specifically represented, of the folding jaw cylinder 14. The printed products 08, which are transversely folded in this way, are further conveyed by the folding jaw cylinder 14 as far as a location where they are transferred to a paddle wheel, also not represented, for deposit onto a conveyor belt.

Figure 2:
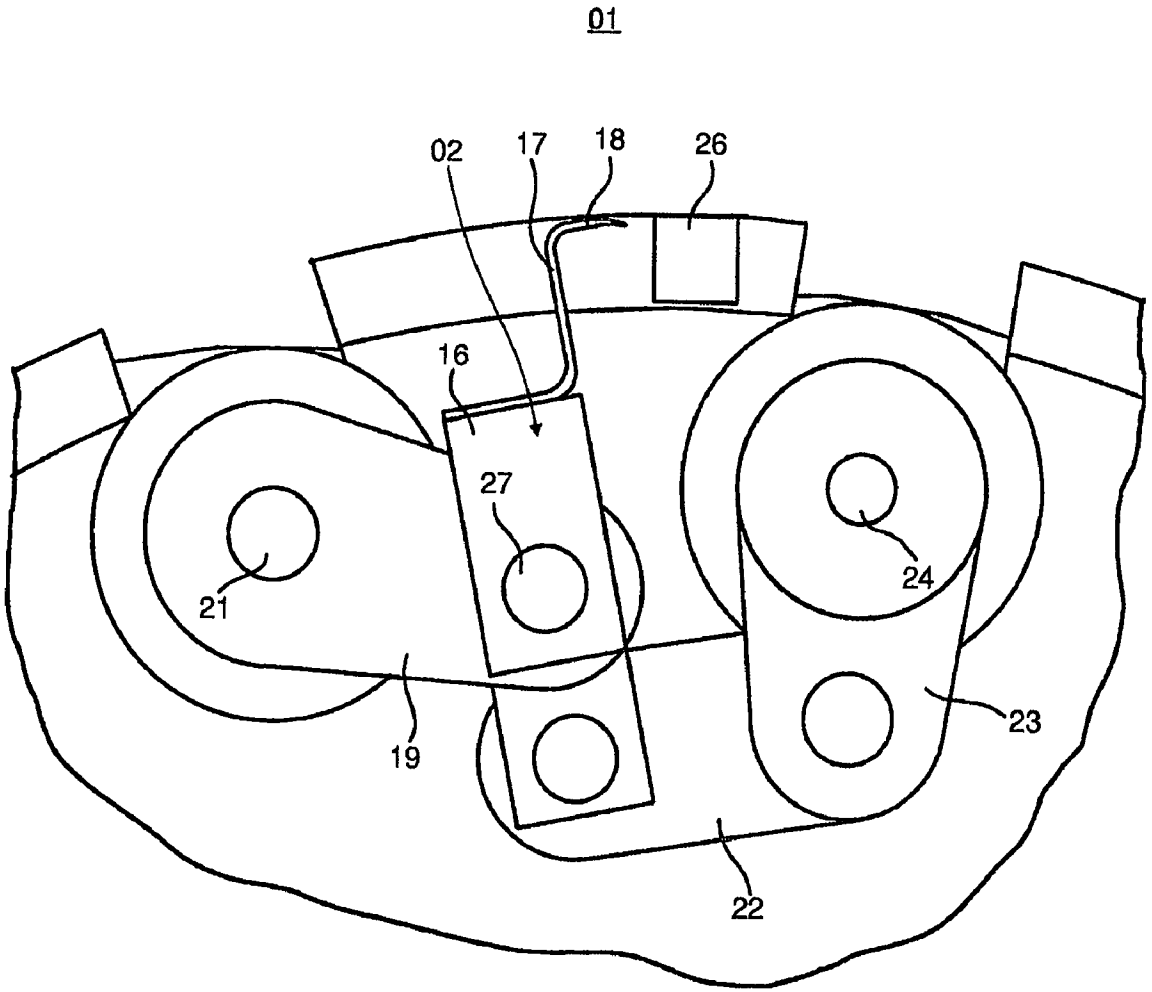

FIG. 2 shows a gripper 02 and its surroundings in a partial cross section that is taken transversely with respect to the axis of rotation of the gripper cylinder. The gripper 02 comprises a support beam 16 extending over the entire usable width of the gripper cylinder 01, which support beam 16 has, on a radially outward directed side, a double-L or double-Z profiled element 17 that is made of an elastic or flexible metallic material, such as, for example, spring steel, which profiled element 17 can be extended for engaging and clamping the printed products 08. The profiled element 17 can extend continuously in the axial direction of the gripper cylinder 01, or it can alternatively be divided into a plurality of tines that are spaced apart in the axial direction, each of which tines extends through an opening in the shell face of the gripper cylinder 01.

On one side, the support beam 16 is hinged to a first arm 19, which is fixedly connected with a first shaft 21, which first shaft 21 is rotatably seated in the gripper cylinder 01. The first arm 19 extends approximately parallel, with respect to the shell face of the gripper cylinder 01. The support beam 16 is furthermore hinged to a coupling rod 22, which is also aligned approximately parallel in respect to the shell face of the gripper cylinder 01 and which coupling rod 22 is hinged on an approximately radially oriented second arm 23. This second arm 23 is fixedly connected with a shaft 24, which is rotatably seated in the gripper cylinder 01. The rotated position of the two arms 19, 23 is determined in a manner which is generally known, and which is not specifically represented in FIG. 2, by the use of two cam disks, which do not rotate together with the gripper cylinder 01 and which cam disks are traced or followed by an arm, which is connected with the shaft 21 or 24, and which is also not specifically represented.

It can be readily understood, by a review of FIG. 2, that a rotation of the first arm 19 around the shaft 21 substantially causes a radial inward or outward movement of the gripper 02, and to a lesser extent at most a pivot movement of the gripper 02 around the shaft 27 through which the support beam 16 and the first arm 19 are hinged to each other. However, assuming the shaft 21 is fixed, a rotation of the shaft 24 would cause a pivot movement of the gripper 02 around the shaft 27.

The gripper cylinder 01, which is partially shown in FIG. 2, rotates in a counterclockwise direction. In the clockwise direction of gripper cylinder 01, and behind the opening of the cylinder shell containing the profiled element 17, a hard rubber strip has been inserted into the cylinder shell. A surface section 26 of the hard rubber strip, and is, for example, used as a counter-thrust element strip 26 for the cutter 06 of the cutter cylinder 04 when that cutter 06 is cutting the continuous web 07. In the configuration represented in FIG. 2, in which the gripper 02 is retracted into the interior of the gripper cylinder 01, the gripper 02 can pass through the cutting gap 09, in the course of which passage, the continuous web 07, which is not specifically represented in FIG. 2, is severed at the level of the counter-thrust element strip 26. The gripper 02 is then extended out of the gripper cylinder 01 to grasp the newly formed leading edge 12 of the continuous web 07 being formed in the course of this cutting, and for pressing leading edge 12 against the counter-thrust element strip 26, as seen in FIG. 1.

Figure 3:
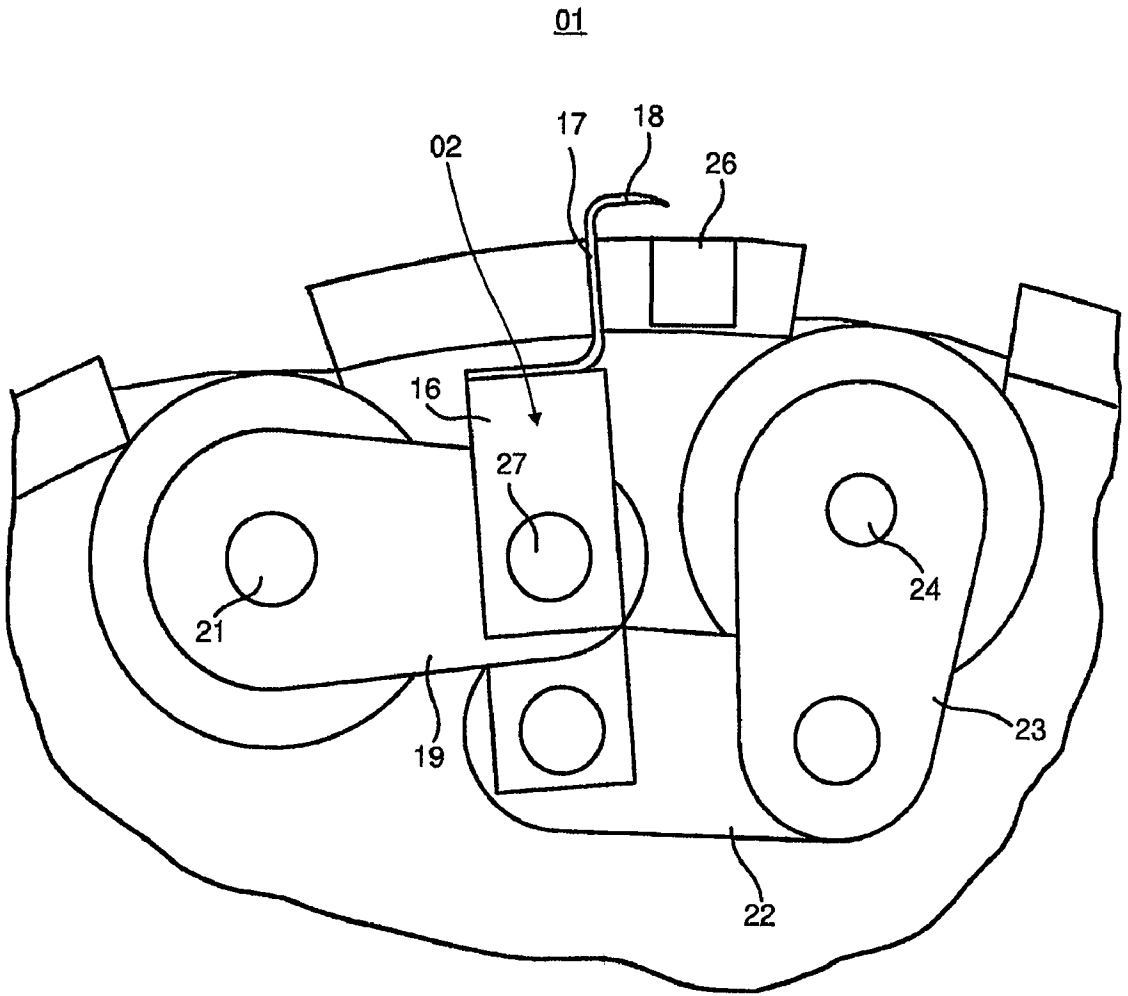

FIG. 3 shows an intermediate position during the extension of the gripper 02. It is possible to see that the shaft 21 has been rotated in a counterclockwise direction, by a comparison between the configurations of FIGS. 2 and 3, because of which rotation of shaft 21, the shaft 27 has been displaced radially outwardly and the profiled element 17 of the gripper 02 has emerged from the opening of the cylinder shell. Moreover, the gripper 02 has been pivoted in a clockwise direction around the shaft 27 by a slight rotation of the shaft 24 in a clockwise direction, so that the tip of the free leg 18 of the profiled element 17 now lies radially above the counter-thrust element strip 26.

Figure 4:
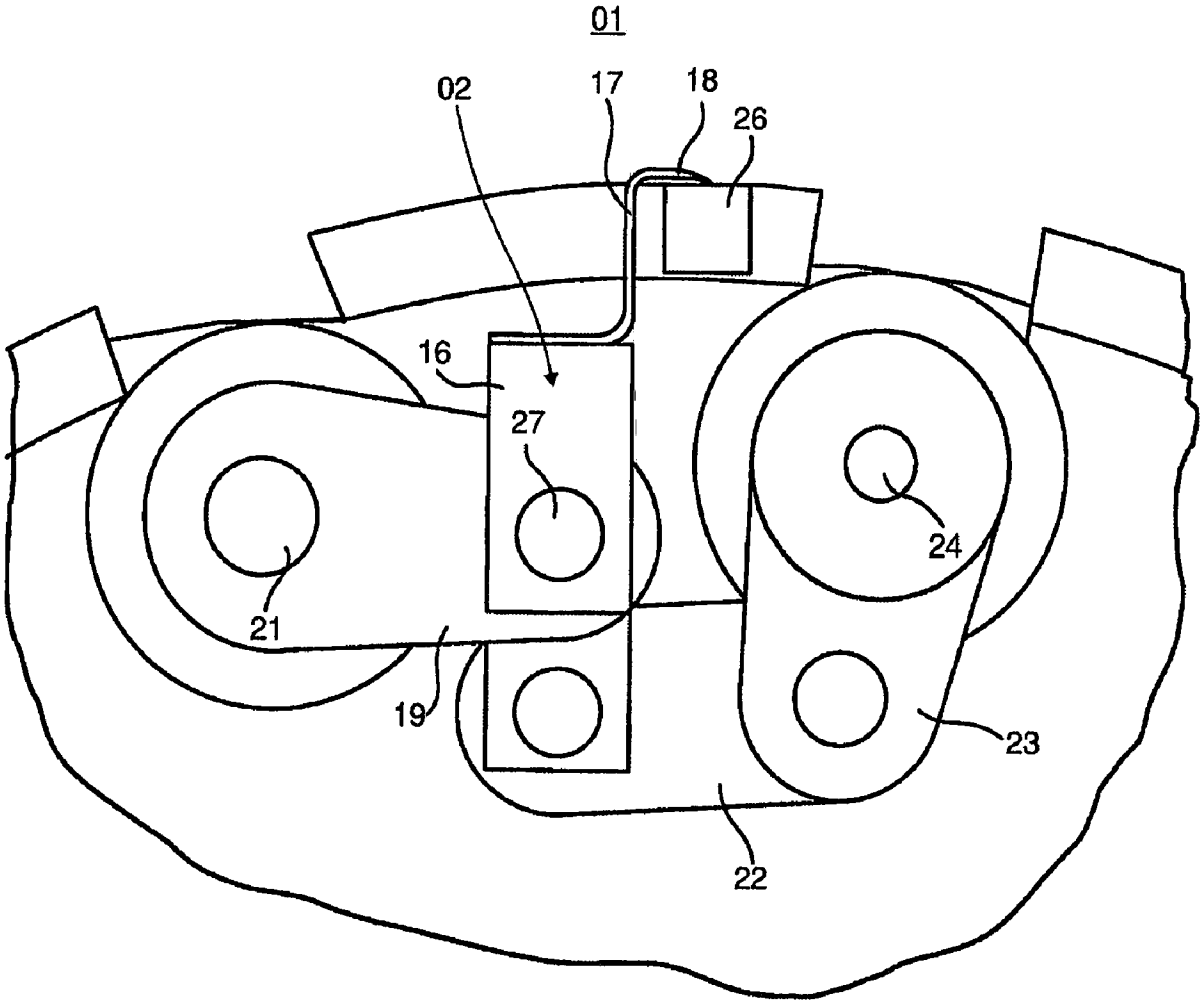

As represented in FIG. 4, the shaft 27 of the gripper 02 is now again displaced radially into the interior of the gripper cylinder 01 by a rotation of the shaft 21 in a clockwise direction. The free end or leg 18 of the profiled element 17 is now lowered onto the counter-thrust element strip 26 and, in the process, clamps the leading end of the continuous web 07 located between it and the counter-thrust element strip 26, which web 07 is not specifically represented in FIG. 3.

Figure 5:
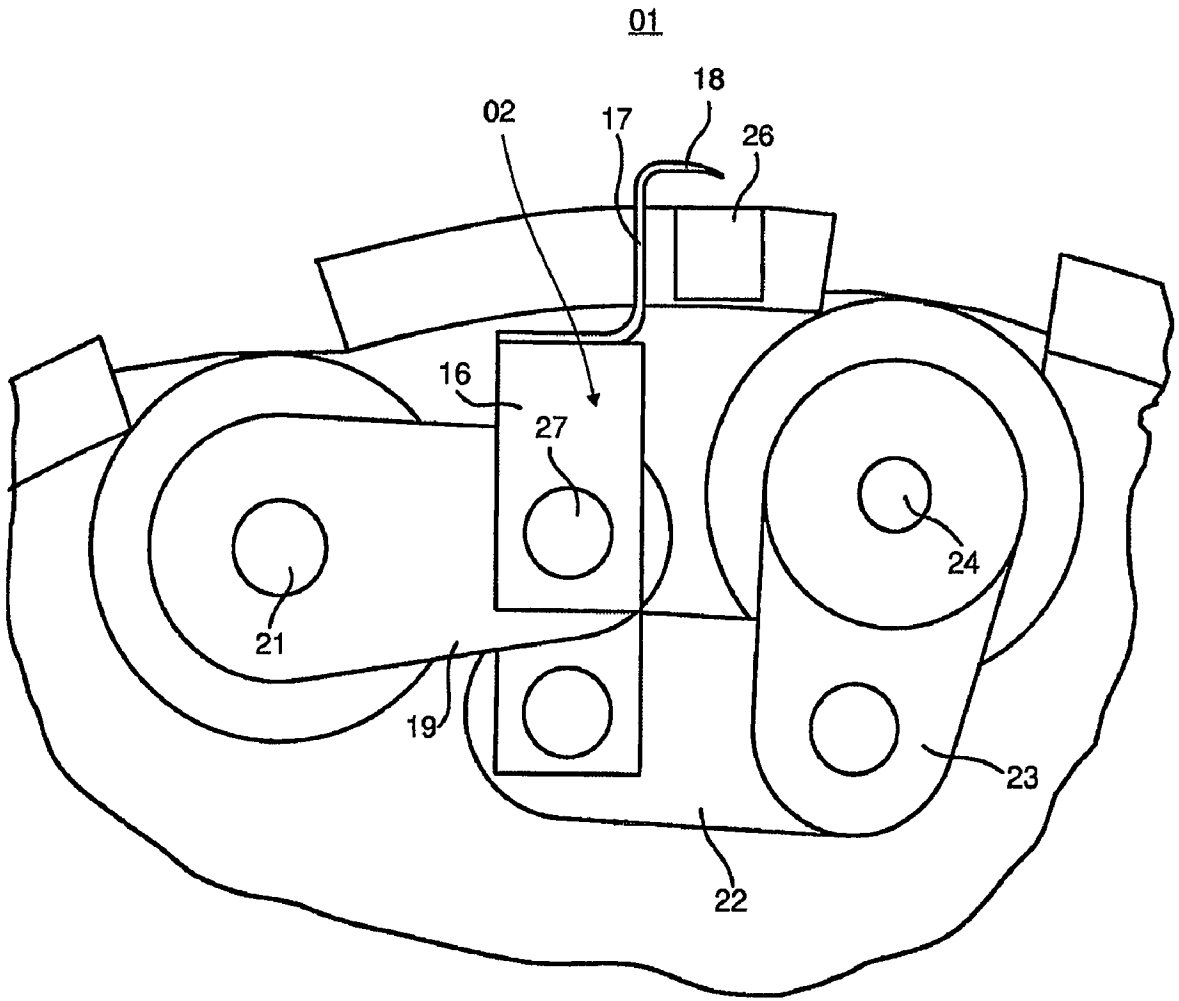

After the passage of the gripper 02 through the folding gap 13, the gripper 02 is again raised by a rotation of the shaft 21 in a counterclockwise direction, and the printed product 08, which had been clamped between the free end or leg 18 and the counter-thrust element strip 26 is released, as shown in FIG. 5, which is shown without the printed product 08. The shaft 24 is pivoted from this configuration in a counterclockwise direction, in order to pull the free leg or end 18 of the gripper 02 past the counter-thrust element strip 26 and over the opening of the cylinder shell. By a subsequent rotation of the shaft 21 in a clockwise direction, the gripper 02 is again pulled back into the interior of the gripper cylinder 01 into the position shown in FIG. 2. The gripper 02 is now ready for another passage through the cutting gap 09.

As can be seen, a small pivot angle of the gripper 02 is sufficient to move it between the clamping position and the retracted position. The radial travel of the gripper 02 is also limited, depending on the thickness of the printed product 08 to be processed, to a few millimeters. Since the gripper 02 can be simply constructed, its weight and moment of inertia are not substantial. The short strokes between the retracted position and the clamping position of the gripper 02 require low accelerations and therefore moderate driving forces, which moderate forces are easy on the material being gripped.

Figure 6:
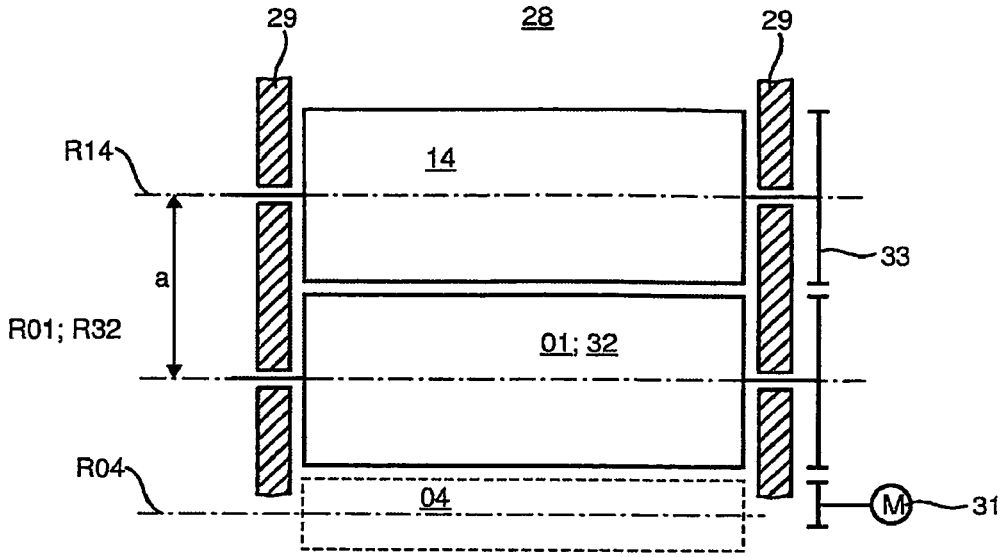
Figure 7:
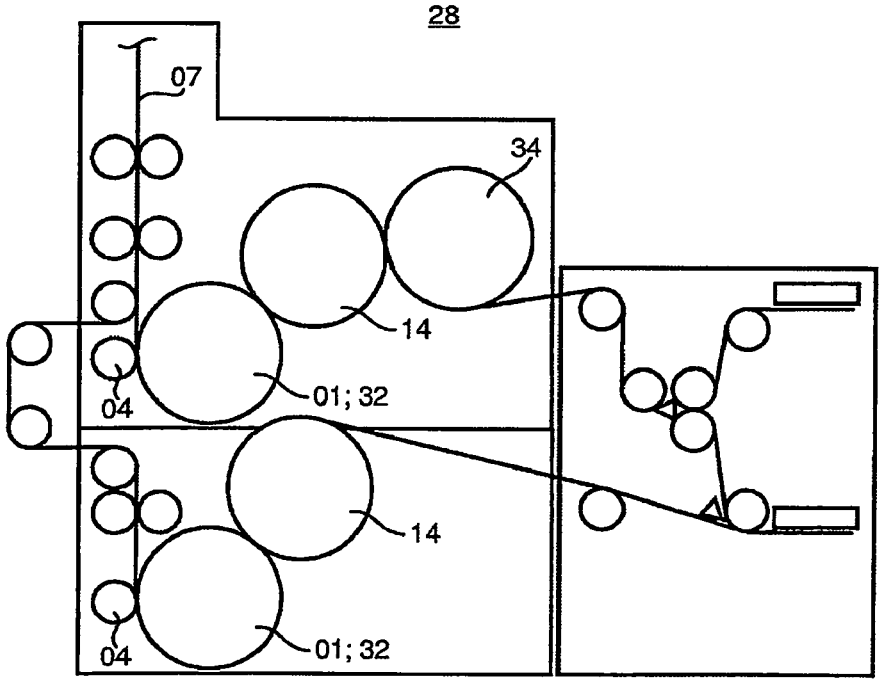

Particularly advantageous embodiments of a variable folding apparatus 28, using a first cylinder 01, are represented in the discussion which follows. As has already been shown in FIG. 1, and as depicted in FIGS. 6 and 7, the folding apparatus 28 has a first cylinder 01, which is here initially generally called a folding blade cylinder 01, and has a second cylinder 14, such as a folding jaw cylinder 14. As is depicted only schematically in cross-section in FIG. 6, the cylinders 01, 14 are seated in a common frame 29 and are driven by at least one drive motor 31. For example, driving of the cylinders 01, 14 takes place from the drive motor 31 via a gear, or also can take place axially directly to the first cylinder 01 and from there via a schematically indicated drive connection 33, such as, for example, gear wheels to the second cylinder 14.

The folding apparatus 28 is configured in such a way that in a first embodiment, it is equipped with a first cylinder 01 which is a gripper cylinder 01, and, in a second embodiment, the folded apparatus 28 is provided with one first cylinder which is a spur needle cylinder 32. The gripper cylinder 01 and the spur needle cylinder 32 are both structured for receiving the same section lengths. The selectively employed gripper cylinder 01 has the same circumference as the folding jaw cylinder 14 which is working together with it. The same applies to the selectively employable spur needle cylinder 32. The sections, or cut-off printed products 08, which follow each other on the circumference of the first cylinder, are arranged on the folding jaw cylinder 14 without being spaced apart from each other. This may be accomplished, for example, by the use of the above represented embodiment of the gripper mechanism. The spur needle cylinders 32, which are embodied for the same section length; i.e. for the length of the cut-off printed products 08, and which may be selectively employed, and the folding jaw cylinders 14 have the same circumference and, during operations, have a circumferential speed corresponding to the speed of the continuous web, or of the paper.

The embodiments of the folding apparatus 28 are such that the arrangement of either the gripper cylinder 01 or the spur needle cylinder 32, with respect to the frame 29, is the same for the selective employment of either the gripper cylinder 01 and the spur needle cylinder 32. In both embodiments, the axes of rotation R01, R32 and R14 between the first cylinder 01 or 32 and the second cylinders 14 have the same distance "a," with the same section format, and are preferably at the same relative distance, with regard to the frame 29, in both embodiments. Preferably, the embodiments and positions of the drive train 33, and/or the positions of the drive motor 31 also correspond in both embodiments. If gear wheel connections are arranged as the drive train 32 between the cylinders 01 and 14, or between the cylinders 32 and 14, the gear wheels of the first cylinder 01, 32 and of the second cylinder 14 have the same number of teeth.

When retaining the seating arrangement of the cylinders 01, 32 in the frame 29, the drive geometry, the transmission ratio and/or the relative position between the first cylinder 01, 32, which is also a folding blade cylinder, and the second cylinder 14, which is the folding jaw cylinder 14 for the same section format, in one embodiment, in which the first cylinder 01, 32 is a spur needle cylinder 32, and in a second embodiment, in which it is provided as gripper cylinder 01, remain the same.

In a particularly advantageous embodiment, specifically with regard to minimal expenditures for construction and/or refitting, the distance "a" between the axes of rotation R01 and R04, as well as between R32 and R04, between the first cylinder 01, 32 and the cutter cylinder 04, which axes are shown in dashed lines are the same for both embodiments. The same applies to the position and/or to the embodiment of a drive connection, which is not specifically represented, between the first cylinder 01, 32 and the cutter cylinder 04.

In an embodiment which is not specifically shown, but which is advantageous for refitting, the frame 29 has a recess on at least one end face of the first cylinder 01, 32, which recess makes the removal and/or the installation of the first cylinder 01, 32, of the frame 29, from the side possible. In this case, this recess can be of such dimensions, so that, for example, the cylinder 01, 32 can be passed through the frame 29 and that during operations of the folding apparatus, this recess is closed by a bearing receiving the journal of the cylinder 01, 32 and, if provided, a ring that is surrounding the latter. For both types of folding apparatus, equipped with the first cylinder 01, 32, a frame 29 is, for example, provided with identical bores for receiving bearings for supporting the two types of cylinders 01, 32.

For the embodiment of the first cylinder as a spur needle cylinder 32, as well as the embodiment of the first cylinder as a gripper cylinder 01, the circumference of the first cylinder 01, 32 substantially corresponds to a whole number multiple of the length L of the product sections 08 to be processed. This means that in the embodiment of the first cylinder as a gripper cylinder 01, there are no gaps between the product sections 08 received on the gripper cylinder 01, or no precession in respect to the continuous web.

The grippers 02 that are assigned to a defined product section 08 are arranged, as viewed in the direction of rotation of the gripper cylinder 01, upstream of the associated counter-thrust element strip 26. This means that the grippers 02 pass through the cutting gap 09 shortly ahead of, or before the counter-thrust element strip 26 passes through the cutting gap 09.

As depicted in FIG. 7, there are shown a first and a second folding apparatus 28, each with at least one first cylinder 01, 32, a second cylinder 14, that is embodied as folding jaw cylinder 14, and a cutter cylinder 04, by the use of which, product sections 08 of a defined length L can be cut from a continuous web 07. In both of these folding apparatuses 28, or embodiments, the first cylinder 01, 32 and the second cylinder 14 are seated in a common frame 29. The first folding apparatus 28 is configured with a first cylinder 32 which is embodied as a spur needle cylinder 32. The second folding apparatus 28 is configured with a first cylinder 01 which is embodied as a gripper cylinder 01. Both folding apparatuses 28 are intended for processing product strips 08 of the same length. The seating arrangement for the first and second cylinders 01, 32, 14 in the frame 29, and/or a drive geometry for at least the first and second cylinders 01, 32, 14, and/or a relative position between the first cylinder 01, 32 and the second cylinder 14 in both folding apparatuses 28 is, or are, the same.

In an advantageous further development of the folding apparatus 28 represented in FIG. 7, it is configured as a double folding apparatus 28, which has two cylinder groups, each group with a respective first cylinder 01, 32 and a respectively associated folding jaw cylinder 14, as well as a cutter cylinder 04. For example, following a division of the continuous web 07, these two groups can be simultaneously provided with partial continuous webs. As explained above in connection with the single folding apparatus 28, the structure of the double folding apparatus 28, with regard to its frame, the position of the cylinders, the drive train and/or the drive motor 31 is such that a selective equipping of the folding apparatus 28 with a first cylinder 01, 32, which is embodied either as a spur needle cylinder 32 or as a gripper cylinder 01, can take place. The folding apparatus 28, either single or double, therefore need not be constructed as a whole in two embodiments. Only the first cylinder 01, 32 and, if required, only guide devices, such as web guidance devices and/or product guidance devices, need to be changed.

In a further development of the double folding apparatus 28, the latter has a further cylinder 34, at least in one cylinder group, by the use of which further cylinder 34 the product can be provided with a second transverse fold.

While preferred embodiments of a folding apparatus, in accordance with the present invention, have been set forth fully and completely hereinabove, it will be apparent to one of skill in the art that various changes in, for example, the type of web being handled. The drive assemblies for the cylinders, and the like could be made without departing from the true spirit and scope of the present invention which is accordingly to be limited only by the appended claims.

What is claimed is:

1. A folding apparatus comprising:

at least a first cylinder having a first circumferential speed and a first circumferential length;

a second cylinder, embodied as a folding jaw cylinder and cooperating with said first cylinder, said second cylinder having a second circumferential length equal to said first circumferential length of said first cylinder, said second cylinder having a second circumferential speed equal to said first circumferential speed of said first cylinder;

a cutter cylinder cooperating with said first cylinder and adapted to sever product sections of a defined length from a continuous web having a feeding speed corresponding to both said first circumferential speed and said second circumferential speed, said product sections having said defined length being received on said first cylinder, whose first circumferential length is a whole number of said product section length, without spacings between adjacent ones of said product sections;

a common frame supporting said first cylinder and said second cylinder as a first folding group;

a seating arrangement of said first cylinder and said second cylinder in said frame, said seating arrangement being usable to support said first cylinder configured selectively as one of a gripper cylinder and a spur needle cylinder and having a drive geometry, a relative position between said first cylinder and said second cylinder in said seating arrangement being the same when said first cylinder is configured selectively as said one of a gripper cylinder and a spur needle cylinder.

2. The folding apparatus of claim 1 wherein said first cylinder is said gripper cylinder, said gripper cylinder having grippers movable both in a pivoting movement and in a transatory movement.

3. The folding apparatus of claim 1 wherein a transmission ratio between said first cylinder and said second cylinder is the same for each of said selectively one of said gripper cylinders and said spur needle cylinder as said first cylinder.

4. The folding apparatus of claim 1 wherein said first cylinder has a first axis of rotation and said second cylinder has a second axis of rotation, a spacing distance between said first and second axes of rotation being the same for each of said selectively one of said gripper cylinders and said spur needle cylinder as said first cylinder.

5. The folding apparatus of claim 1 wherein a selective position of said first cylinder in said common frame is the same for each of said selectively one of said gripper cylinder and said spur needle cylinder as said first cylinder.

6. The folding apparatus of claim 1 further including bores in said common frame and adapted to receive bearings supporting said first cylinder.

7. The folding apparatus of claim 1 further including a drive motor having a fixed relative position.

8. The folding apparatus of claim 1 further including a recess in said common frame and adapted to exchange said first cylinder.

9. The folding apparatus of claim 1 wherein said first cylinder is a gripper cylinder having a cylinder body with at least one gripper, said at least one gripper being movable between a first position retracted into said cylinder body, a second position extended out of said cylinder body and a third, clamping position, said at least one gripper having a tip, said tip, in said clamping position, being adapted to press a leading edge of said continuous web against a surface section of said cylinder body.

10. The folding apparatus of claim 9 wherein said gripper cylinder includes a first shaft which is movable in a radial direction in said gripper cylinder, said gripper being pivotable around said first shaft between said retracted position and said extended position.

11. The folding apparatus of claim 10 wherein said pivotal movement of said gripper and said radial movement of said shaft are coupled, whereby said first shaft moves radially inwardly during said pivotal movement of said gripper into said clamping position.

12. The folding apparatus of claim 10 further including a first arm supporting said first shaft, and a second shaft, said second shaft being rotatable in said cylinder body, said first arm being pivotable about said second shaft to effect said radial movement of said first shaft.

13. The folding apparatus of claim 12 further including a first cam disk adapted to cause said pivot movement of said first arm.

14. The folding apparatus of claim 13 further including a coupling rod having a first end connected to said gripper and a second end connected to a second arm, and further including a third shaft, said second arm being pivotable about said third shaft to drive said pivot movement of said gripper.

15. The folding apparatus of claim 14 further including a second cam disk adapted to cause said pivot movement of said second arm.

16. The folding apparatus of claim 14 wherein said first arm is oriented in a circumferential direction of said cylinder body and said second arm is oriented in a radial direction of said cylinder body.

17. The folding apparatus of claim 1 wherein said first cylinder is said gripper cylinder and including a gripper supported by a shaft, said shaft being movable in a radial direction of said gripper cylinder.

* * * * *